US012727637B2

(12) United States Patent
Kobayashi et al.

(10) Patent No.: US 12,727,637 B2
(45) Date of Patent: Sep. 8, 2026

(54) COOLING STRUCTURE USED FOR HEADGEAR AND LIKE

(71) Applicant: NICHIYOU HATSUMEI GALLARY CO LTD, Yaizu City (JP)

(72) Inventors: Toyohiro Kobayashi, Yaizu City (JP); Akiko Yamada, Yaizu City (JP); Shinichirou Nakajima, Tokyo (JP)

(73) Assignee: NICHIYOU HATSUMEI GALLARY CO LTD, Yaizu City (JP)

( * ) Notice: Subject to any disclaimer, the term of this patent is extended or adjusted under 35 U.S.C. 154(b) by 0 days.

(21) Appl. No.: 19/339,300

(22) Filed: Sep. 25, 2025

(65) Prior Publication Data

US 2026/0020633 A1 Jan. 22, 2026

Related U.S. Application Data

(63) Continuation of application No. PCT/JP2024/024792, filed on Jul. 9, 2024.

(30) Foreign Application Priority Data

Dec. 15, 2023 (JP) ..... 2023-212228

(51) Int. Cl.
*A42B 1/008* (2021.01)
*A42B 1/019* (2021.01)

(52) U.S. Cl.
CPC ..... *A42B 1/008* (2013.01); *A42B 1/019* (2021.01)

(58) Field of Classification Search
CPC ..... A41D 13/0053; A41D 13/04; A41D 13/0083; A42B 1/008; A42B 1/019
See application file for complete search history.

(56) References Cited

U.S. PATENT DOCUMENTS 4,484,363 A * 11/1984 Varanese ..... A42C 5/04 2/181.6
6,125,474 A * 10/2000 Gillette ..... A42B 1/008 2/171.2

(Continued)

FOREIGN PATENT DOCUMENTS

JP 2001-146621 A 5/2001
JP 2006-328615 A 12/2006

(Continued)

OTHER PUBLICATIONS

International Search Report for PCT/JP2024/024792 dated Aug. 6, 2024.
PCT written opinion dated Aug. 6, 2024.

*Primary Examiner* — Alissa L Hoey
*Assistant Examiner* — Akwokwo Olabisi Redhead
(74) *Attorney, Agent, or Firm* — Yokoi & Co., U.S.A.; Toshiyuki Yokoi

(57) ABSTRACT

A water inlet is provided at a top portion of a main body portion of a headgear or the like for pouring water from a plastic bottle into the water inlet. The back side of the main body portion and a flap portion are covered with moisture-permeable waterproof fabrics on one side or partially on both sides of sheet-like absorbent materials. A gap is formed as a water channel for water to flow between the absorbent materials and the moisture-permeable waterproof fabrics. A drain outlet is provided at the bottom edge of the flap portion to detect the fact that the water reaches the bottom edge. The absorbent materials are placed avoiding a head circumference size adjustment portion and a boundary connection portion between the main body portion and the flap portion. A water channel is connected in a sheath-tube manner formed of moisture-permeable waterproof fabric.

4 Claims, 6 Drawing Sheets

(56) References Cited

U.S. PATENT DOCUMENTS

| | | | | |
|---|---|---|---|---|
| 6,966,072 | B1 | 11/2005 | Kobayashi | |
| 2002/0035745 | A1* | 3/2002 | Spell | A61F 7/103 2/209.13 |
| 2004/0055072 | A1* | 3/2004 | Lee | A41D 13/0053 2/171 |
| 2008/0163406 | A1* | 7/2008 | Solari | A42B 1/22 2/195.3 |
| 2009/0049578 | A1 | 2/2009 | Toyohiro | |
| 2009/0205107 | A1 | 8/2009 | Coba | |
| 2010/0037366 | A1* | 2/2010 | Panicali | A42B 1/008 2/209.13 |
| 2012/0144555 | A1* | 6/2012 | Panicali | A42B 1/008 2/171.2 |
| 2014/0318154 | A1* | 10/2014 | Kobayashi | F25D 7/00 62/3.5 |
| 2016/0374419 | A1* | 12/2016 | Hunley | A42B 1/008 2/171.2 |
| 2018/0245731 | A1 | 8/2018 | Kohmyohji et al. | |
| 2018/0271195 | A1* | 9/2018 | Noa | A42B 1/0187 |
| 2022/0256957 | A1 | 8/2022 | Nakamura | |

FOREIGN PATENT DOCUMENTS

| | | | |
|---|---|---|---|
| JP | 3130472 | U | 3/2007 |
| JP | 3167051 | U | 3/2011 |
| JP | 2015-52188 | A | 3/2015 |
| JP | 2021-25150 | A | 2/2021 |
| JP | 6920579 | B | 8/2021 |
| WO | 2006/109545 | A | 10/2006 |
| WO | 2013/105478 | A | 7/2013 |

* cited by examiner

COOLING STRUCTURE USED FOR HEADGEAR AND LIKE

CROSS-REFERENCE TO RELATED APPLICATIONS

This application claims the benefit of priority and is a Continuation application of the prior International Patent Application No. PCT/JP2024/024792, with an international filing date of Jul. 9, 2024, which designated the United States, and is related to the Japanese Patent Application No. 2023-212228, filed Dec. 15, 2023, the entire disclosures of all applications are expressly incorporated by reference in their entirety herein.

TECHNICAL FIELD

The present invention relates to a cooling structure for a headgear, a hood or the like for cooling a head, a back of a neck and surrounding areas through evaporative cooling effect of water.

BACKGROUND OF THE INVENTION

As for the conventional cooling structure using the evaporative cooling effect of water, a relatively thick sheet-like water-absorbent material capable of absorbing and storing an amount of water equivalent to multiple times the weight of the water-absorbent material is covered with water-permeable outer and inner fabrics. The above described water-absorbent material is arranged in a headgear or a hood so as to be positioned at the back of the head or the back of the neck, soaked in water, lightly wrung out, and worn to obtain a cooling sensation.

In the above described case, a container such as a wash-basin or a plastic bag is necessary to hold water in order to sufficiently soak and store water in the water-absorbent material. The water-absorbent material needed to be immersed in water for about one minute to absorb the water, and then lightly wrung out to remove excess water before being worn on the head.

Considering typical usage scenarios such as a tennis court, a golf course, a hiking or a jogging in midsummer, it is extremely inconvenient to prepare the above described container and the water to fill the container.

Although it is also possible to pour water onto the above described sheet-like cooling structure from above, this causes water to splash around, which is unpleasant. Especially when doing this in a car while driving to summer recreation or sports venues, it is apparent that water splashing in the confined space of the car would be even more unpleasant.

Patent Document 1 shows a headgear provided with a plastic bag container for storing water and an absorbent material attached to and integrated with a main body portion is soaked in the water kept in the plastic bag container, then the headgear is worn on the head to cool the head through evaporative cooling and help prevent heat stroke. However, after the main body portion is soaked in the water, there is the inconvenience of wringing out excess water, splashing water around and disposing of the remaining water.

Patent Document 2 shows a headgear with a detachable pad made of absorbent material attached to a part of a main body portion that touches a forehead of a person for providing a cooling sensation to the forehead through evaporative cooling. In the above case as well, it is necessary to soak the pad in the water in the container or pour the water from a faucet or the like. Thus, the inconvenience of water splashing is not solved.

PRIOR ART

Patent Documents

Patent Document 1: Japanese Patent No. 6920579

Patent Document 2: Japanese Utility Model Registration No. 3130472

Patent Document 3: Japanese Patent Publication No. 2006-328615

SUMMARY OF THE INVENTION

Problem to be Solved by the Invention

The present invention obtains a cooling structure through evaporative cooling without needing to soak or pour the water on a front (outer) or a reverse (inner) surface of a main body portion of a headgear, a hood or the like and without requiring a container for storing the water.

Means for Solving the Problems

The structure provided on a headgear or the like of the present invention includes a water inlet at the top portion (upper portion) of a main body portion for pouring water from a plastic bottle, a cup or the like. The reverse (inner) surface of the main body portion is covered and wrapped with a sheet-like absorbent material and one side or both sides of the sheet-like absorbent material is covered with a moisture-permeable and waterproof fabric having holes as evaporation ventilation windows on some areas.

A gap is provided as a water channel so that the water flows between the absorbent material and the moisture-permeable waterproof fabric to allow the water poured from the water inlet to flow from top to bottom and left and left evenly in the absorbent material arranged in a sheet-like manner and absorbing and storing the water.

Furthermore, in a headgear provided with a main body portion and a flap portion connected to the main body portion for covering a back of a head and an upper back of a neck, an inner hood worn under a helmet (e.g., a hood for nursing care worker), a water channel connecting portion is provided on the connected portion while avoiding a head circumference size adjustment portion of the headgear or the like so that the water poured from the water inlet flows through the gap of the main body portion and flows into the absorbent material arranged in the flap portion in a sheet-like manner. The connected portion is configured with a moisture-permeable waterproof fabric that makes the width of the water channel smaller at the main body portion side than the flap portion side, and the main body portion and the flap portion are assembled in a sheath-tube manner with sufficient overlapping dimension. Thus, the main body portion and the flap portion can be manufactured separately and efficiently and neatly assembled in the final process. Furthermore, a drain outlet is provided at the bottom edge of the flap portion for intensively discharging excess water after the absorbent material absorbs sufficient water poured from the water inlet. Because of this, it is possible to detect the fact that the water starts to flow from the drain outlet and to know an appropriate amount of the water poured from the water inlet.

Effects of the Invention

In the structure of the headgear or the like of the present invention, the water is poured from a plastic bottle or a cup into the water inlet provided at the top portion of the head. Thus, the water can be supplied all at once to the sheet-like absorbent material placed in the main body portion and the flap portion covering widely the head, the back of the head, the back of the neck of a person and the connected portion of them. Consequently, the evaporative cooling effect can be provided quickly.

In addition, even for the headgear or the hood with the main body portion and the flap portion connected to the main body portion covering the back of the head and the upper back of the neck, the cooling effect through evaporative cooling can be achieved with just a single pour of water from only one water inlet of the main body portion located at the top portion of the headgear to the flap portion located below.

According to the present invention, it is no longer necessary to soak the main body portion and the flap portion in water collected in a washbasin or a plastic bag container different form the conventional technology.

In recent years, vending machines selling cold water in plastic bottles have become widespread. It is easy to obtain cold water at all times in a lounge attached to a sports clubhouse such as a golf course and a tennis court, and on a street corner. Especially in midsummer, a player often carries the plastic bottle during play.

If the player wearing the headgear having the structure of the present invention experiences a decrease in the cooling effect of water evaporation during long periods of play, the player can quickly and easily pour additional cold water from the plastic bottle through the water inlet to quickly restore and reinforce the cooling effect across both the main body portion and the flap portion of the headgear allowing the player to resume play.

Furthermore, the action of pouring the water can be performed in front of fellow players anytime, anywhere. Thus, it is easy to maintain the cooling effect for long periods and it is possible to demonstrate that the headgear of the present invention is very effective against heat stroke. This facilitates recommending the purchase of the headgear of the present invention to friends or the like. Consequently, a groundbreaking effect for promoting heat stroke prevention awareness and significantly boosting sales of the product can be expected.

In the conventional flap hat for children with the cooling effect of water evaporation, tap water or the like is poured over the sheet-like absorbent fibers attached to the back of the flap portion. For example, when many kindergarten children do this, the water splashes around the faucet and the children's cloth gets wet.

However, if the structure of the present invention is used in the flap hat for children, many children can, under a teacher's instruction, simultaneously hold the flap hat with the structure of the present invention in one hand and a cup containing approximately 100 ml of water in the other hand, and simply pour the water through the water inlet of the structure of the present invention. Furthermore, if the children are taught to stop pouring when they detect dripping of excess water from the drain outlet provided at the bottom edge of the flap portion, the children can avoid splashing water and wetting their clothes. After that, if the flap hat is worn, the children can obtain the cooling effect from the head to the nape of the neck through evaporative cooling. This greatly helps with heat measures and heat stroke prevention during children's outdoor activities in midsummer.

DETAILED DESCRIPTION OF THE INVENTION

Figure 1:
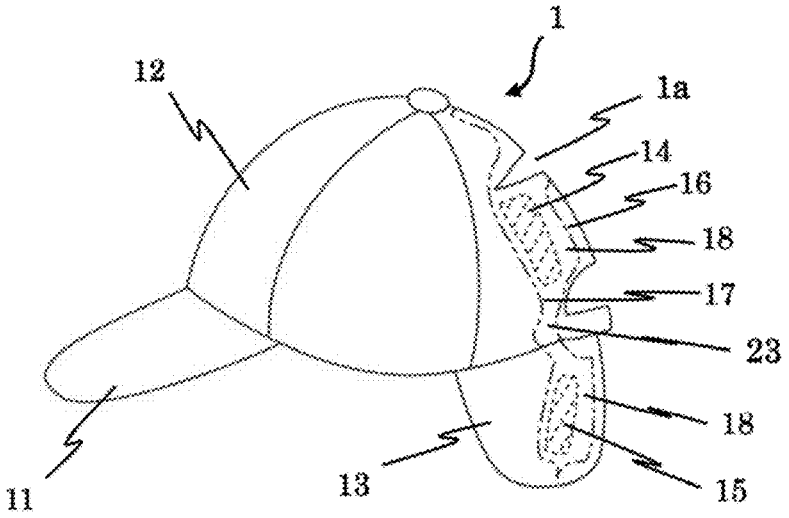
FIG. 1 is a drawing showing a cross-section of a structure of a headgear using the present invention.

A preferred first embodiment of a headgear with the structure of the present invention will be explained more specifically using drawings. FIG. 1 is a drawing showing a cross-section of the structure of the headgear hat using the present invention.

A headgear 1 is composed of a brim portion 11, a main body portion 12 and a flap portion 13 positioned at the back. FIG. 1 also shows a cross-section of a back side of a part of the headgear 1 covering from the back of the head to the upper back of the neck.

A water inlet 1*a* is provided near the top portion of the main body portion 12 of the headgear 1 for pouring water from the water inlet 1. Furthermore, a first absorbent material 14 that absorbs several times its weight in water is placed in a sheet-like manner to cover the back of the head in the main body portion 12. Similarly, a second absorbent material 15 is placed in a sheet-like manner in the flap portion 13 to cover the upper back of the neck.

Both sides of the first and second absorbent materials 14, 15 are covered with moisture-permeable waterproof fabrics 16, 17. For example, a gap 18 having a sheet-like shape is created between the outer moisture-permeable waterproof fabric 16 and the surface of the first and second absorbent materials. The water poured from the water inlet 1*a* flows through the above described gap 18 and reaches the first and second absorbent materials 14, 15, which absorb, retain, and store the water.

Figure 3A:
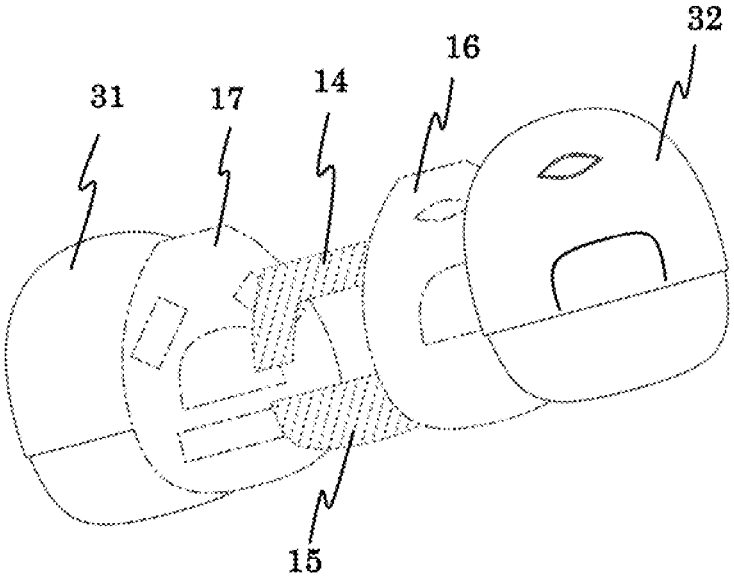
FIG. 3A is a drawing showing a combination structure of multiple fabrics and components used in the structure of the present invention.
Figure 3B:
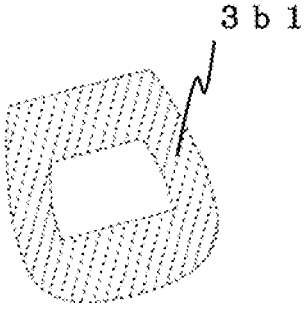
FIG. 3B is a drawing showing the structure with an integrated absorbent material used in the structure of the present invention.

Although the absorbent materials 14, 15 are explained as separate first and second materials in the above explanation, it is noted here that the structure of the present invention can be also configured by providing a continuous, integrated absorbent material 3*b*1 as shown in FIG. 3B as explained below although the effect differs.

Figure 2:
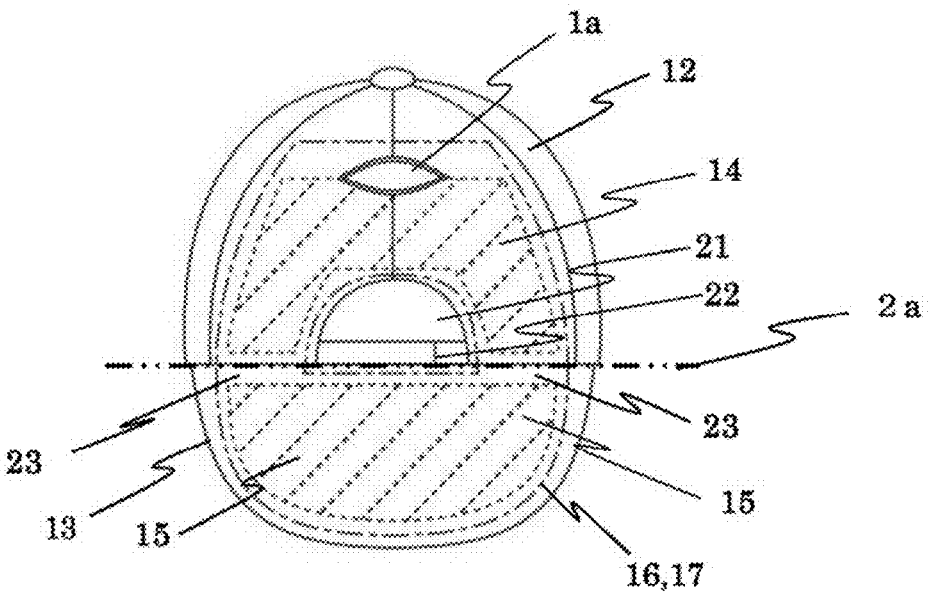
FIG. 2 is a drawing showing a back of the structure of the headgear using the present invention.

Next, FIG. 2 is a drawing showing the back of the structure of the headgear using the present invention.

In general, the headgear includes a head circumference size adjustment portion (size adjuster) 21 and an adjustment band 22 in the center of the back of the main body portion 12 to fit the headgear to a circumference size of a head of a person.

Figure 9:
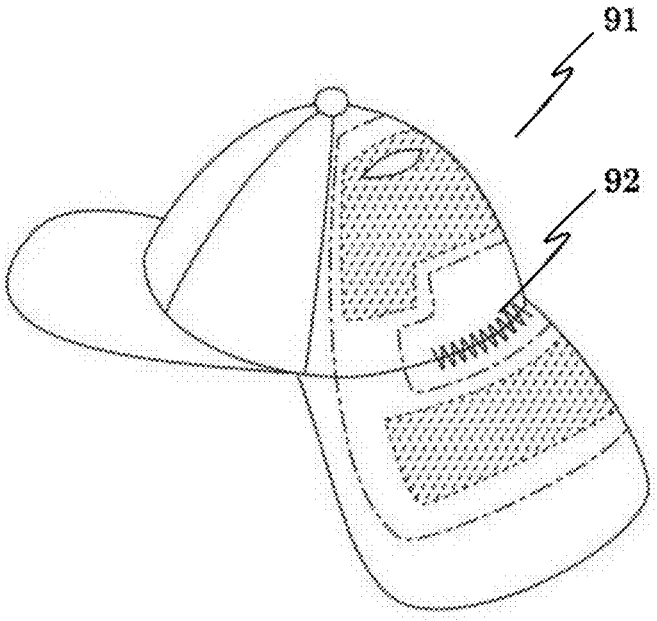
FIG. 9 is a transparent view showing an example of a flap hat for children with the structure used for the present invention.

In addition, the flap hat for children or kindergartners includes an elastic stretching portion 92 for size adjustment in the center of the back of the main body portion as shown in FIG. 9.

The absorbent materials 14, 15, which are dozens of times thicker and harder (with a stiff feeling) than general fabric materials, and the moisture-permeable waterproof fabrics 16, 17 that form the water channel for smooth water flow cannot be placed in the size adjustment portion 21. Therefore, in order to avoid the size adjustment portion 21 and allow the water poured from the water inlet to be absorbed by the first absorbent material 14 in the main body portion and then by the second absorbent material 15 placed in the flap portion located below, it is necessary to obtain the structure that with a water channel connecting portion 23 arranged for avoiding the size adjustment portion and allowing the water flow in the second absorbent material 15 of the flap portion 13 as shown in FIG. 2.

FIG. 3A is a drawing showing the combination structure of multiple fabrics and components constituting the present invention. The multiple fabrics and components shown in FIG. 3A include, a highly breathable lining 31 positioned at the surface faced to the head of the person when wearing the headgear or the like for both the main body portion and the flap portion. Next, an inner moisture-permeable waterproof fabric 17 with holes in various places for evaporation ventilation is placed, and the absorbent materials 14, 15 are attached to the outside of the inner moisture-permeable waterproof fabric 17 by adhesion or sewing. An outer moisture-permeable waterproof fabric 16 is placed covering on the outside of the absorbent materials 14, 15. The outer perimeters of the shapes of the inner moisture-permeable waterproof fabric 17 and the outer moisture-permeable waterproof fabric 16 are joined by adhesion or sewing. Consequently, a water channel 18 can be formed for allowing the water poured from the water inlet 1*a* flow over the surface of the absorbent material while absorbing and storing the water in both the main body portion 12 and the flap portion 13.

At this time, the evaporative cooling effect obtained by the present invention can still be achieved even when the first and second absorbent materials 14 are continuous and integrated as absorbent material 3*b*1 covering the main body portion and the flap portion as shown in FIG. 3B.

Figure 8:
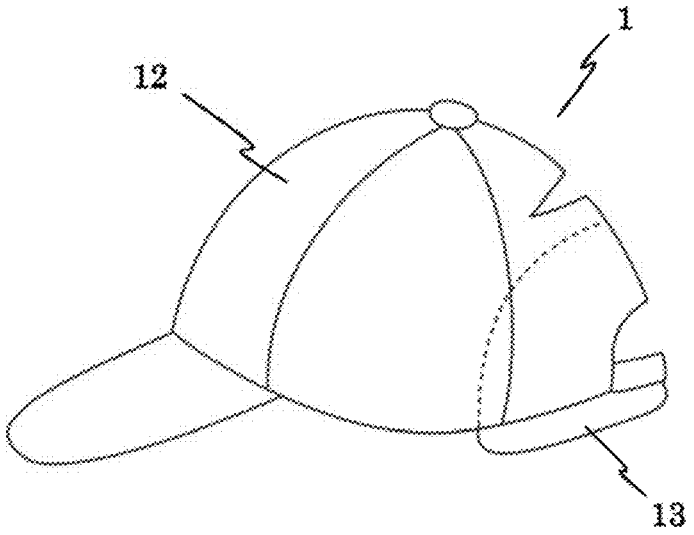
FIG. 8 is a drawing showing a usage form of the headgear with the structure used for the present invention with a flap portion folded into an inside of the main body portion.

However, by separating the absorbent material into the absorbent material 14 for the main body portion and absorbent material 15 for the flap portion and eliminating thick and stiff material in the water channel connecting portion 23 that connects the main body portion 12 and the flap portion 13, as would be the case with the integrated absorbent material 3*b*1 (i.e., the water channel is formed only by soft moisture-permeable waterproof fabric), the flap portion 13 can be neatly and comfortably folded and stored into the main body portion 12. Thus, the headgear can be worn without discomfort as if wearing the headgear with only a normal main body portion for fashion purposes as shown in FIG. 8.

In the drawings, the reference numeral 32 is the outer covering fabric of the main body portion 12 and the flap portion 13.

In addition, the second embodiment with even higher effectiveness in the present invention will be explained.

In the headgear having the structure like the present invention, the main body portion 12 and the flap portion 13 are generally made by separately producing the main body portion 12 and the flap portion 13 and joined with each other by sewing later. The above described water channel connecting portion 23 of the headgear with the structure of the present invention is constructed as follows to make the joining efficiently and easily.

Figure 3C:
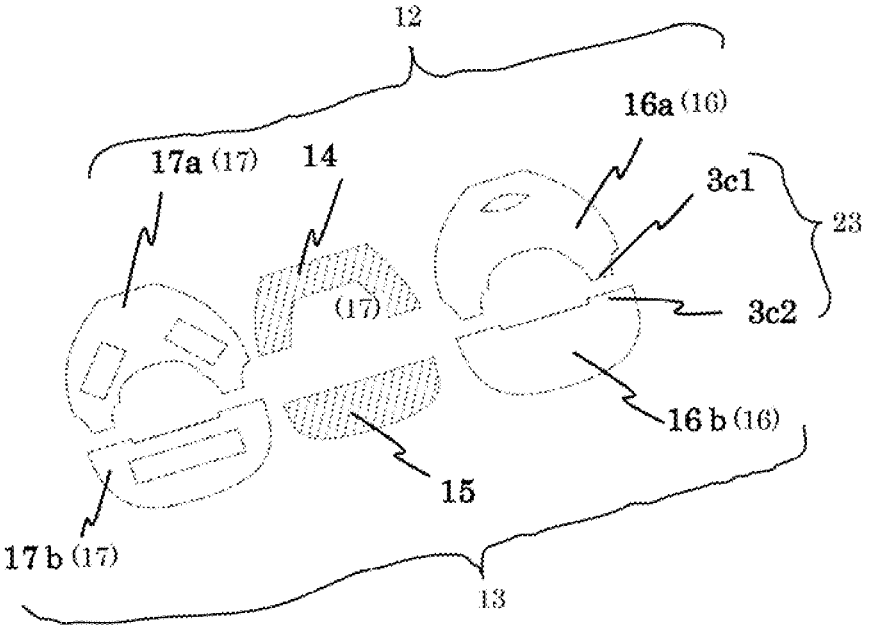
FIG. 3C is a drawing showing the structure using a sheath-tube manner for a water channel used in the structure of the present invention.

As shown in FIG. 3C, the horizontal width of a water channel connecting portion 3*c*2 formed by the inner and outer moisture-permeable waterproof fabrics 17*b*, 16*b* on the flap portion side is made wider than the horizontal width of a water channel connecting portion 3*c*1 formed by the inner and outer moisture-permeable waterproof fabrics 17*a*, 16*a* incorporated in the main body portion 12. When joining the water channels of the main body portion 12 and the flap portion 13, the water channel connecting portion 3*c*1 and the water channel connecting portion 3*c*2 overlap vertically, for example, by making the water channel connecting portion 3*c*1 on the main body portion side longer.

The main body portion 12 and the flap portion 13 are separately assembled and manufactured and the horizontal circumferences of them are joined by sewing while avoiding the water channel connecting portion 23. The water channel connecting portion 23 is formed by inserting the tubular water channel portion 3*c*1 formed by the moisture-permeable waterproof fabric on the main body portion side into the tubular water channel portion 3*c*2 having a slightly larger diameter on the flap portion 13 side for connecting them in a sheath-tube manner. Thus, the water channel connecting portion 23 described above is formed. Since the entire horizontal circumference of the main body portion 12 and the flap portion 13 can be connected while avoiding only the water channel connecting portion, the headgear, the hood for a helmet inner or the like with the structure of the present invention can achieve the effect of obtaining the water channel connecting portion 23 as the water channel portion to allow the water to flow while efficiently simplifying the assembly.

Figure 4:
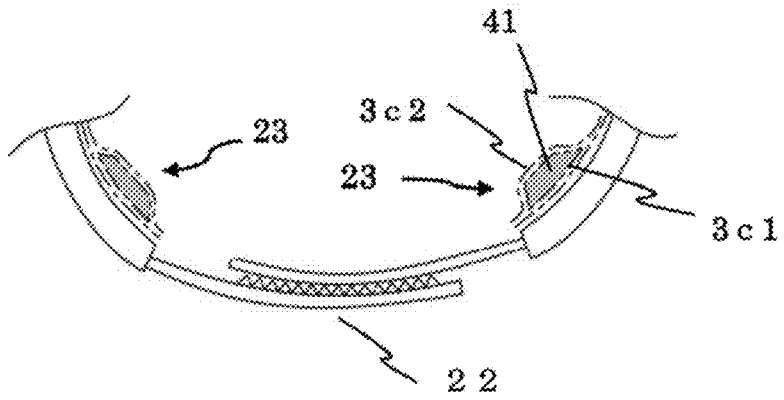
FIG. 4 is a drawing showing a cross-section of a water channel connecting portion of the headgear using the present invention.

FIG. 4 is a drawing showing a cross-section of the water channel connecting portion 23 of the headgear using the present invention described above. The cross-section shows the structure of the sheath-tube manner as seen when cut along the cross-section line 2*a* shown in FIG. 2.

FIG. 4 explains a state that the water channel connecting portion 3*c*1 on the main body portion side and the water channel connecting portion 3*c*2 with a wider horizontal diameter on the flap portion side are connected in a sheath-tube manner and the above described water channel connecting portion 23 is formed so that the water 41 flows from the main body portion side to the flap portion side at both sides of the band portion 22 of the size adjustment portion 21 while avoiding the size adjustment portion 21.

Figure 5:
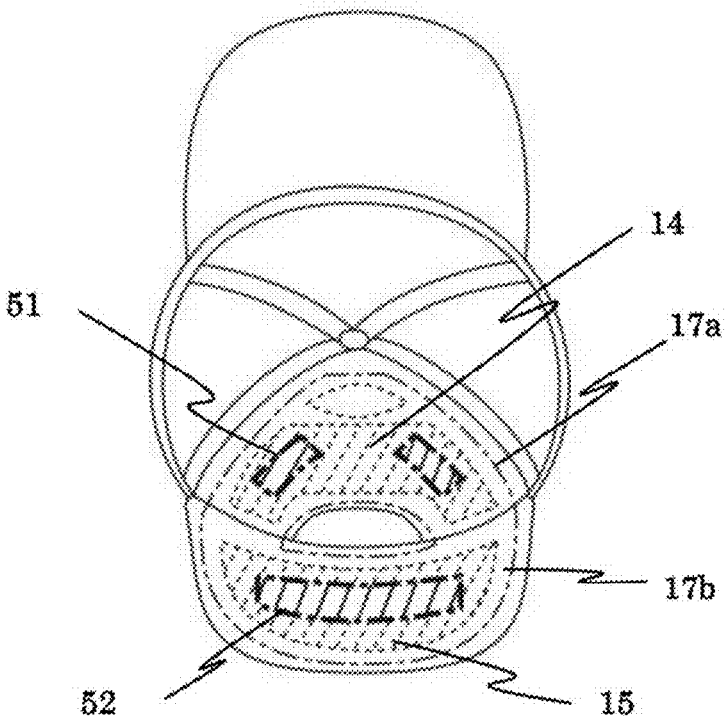
FIG. 5 is a drawing showing a bottom surface of the headgear used for the present invention.

FIG. 5 is a drawing showing the bottom surface of the headgear used for the present invention.

FIG. 5 shows the arrangement configuration of the evaporation ventilation windows 51, 52 provided in the inner moisture-permeable waterproof fabrics 17*a*, 17*b* to promote evaporative cooling of the water absorbed by the absorbent materials 14, 15.

Figure 6:
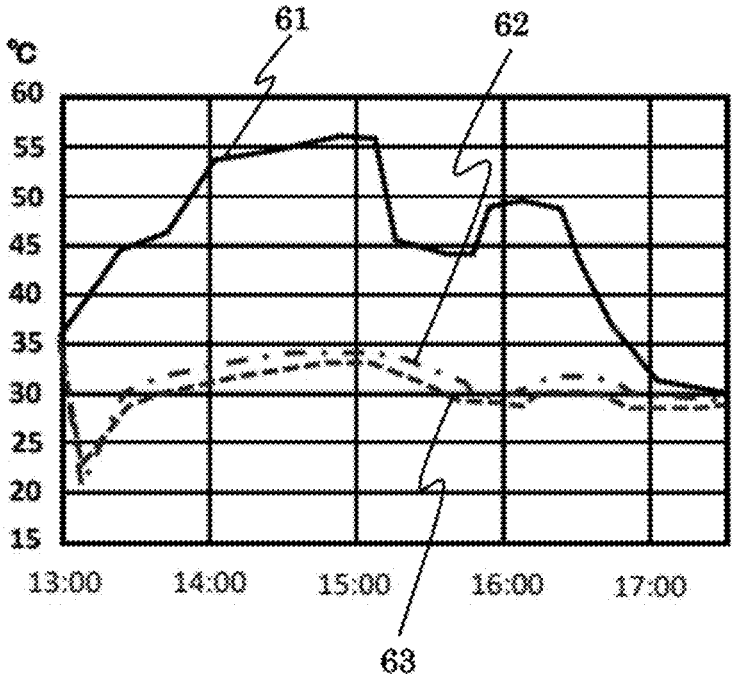
FIG. 6 is a drawing showing a cooling temperature effect of the headgear with the structure used for the present invention in a graph.

FIG. 6 is a drawing showing the cooling temperature effect of the headgear with the structure used for the present invention in a graph.

In summer, on a certain sunny day around 1 PM, approximately 100 ml of cold water (around 12° C.) was poured into the water inlet 1*a* of the headgear with the structure of the present invention, the headgear was worn after 10 minutes. During several hours of strolling on street corners, in parks, watching competitions, etc., the temperature 61 of the top portion of the main body portion 12, the temperature 62 of the reverse side (human side) of the main body portion and the temperature 63 (back side of the neck of the human) of the back side of the flap portion were measured and plotted on a graph.

When the headgear of the present invention is worn, important parts of the human body for heat stroke prevention, such as from the upper to lower back of the head and upper back of the neck are effectively cooled and protected against environment with high temperature exposure due to solar radiation.

Figure 7A:
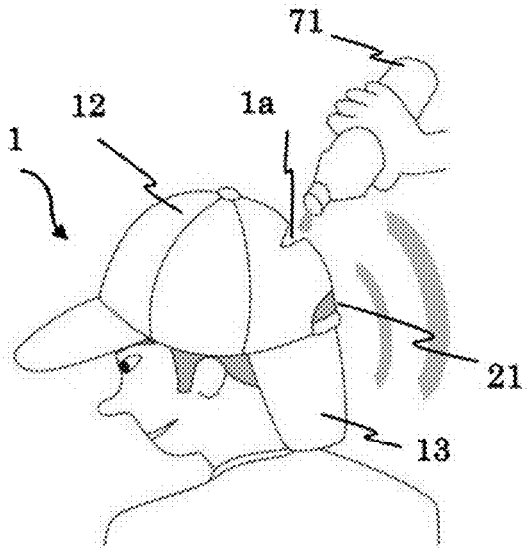
FIGS. 7A and 7B are drawings showing a usage state of the headgear, the hood or the like with the structure used for the present invention.
Figure 7B:
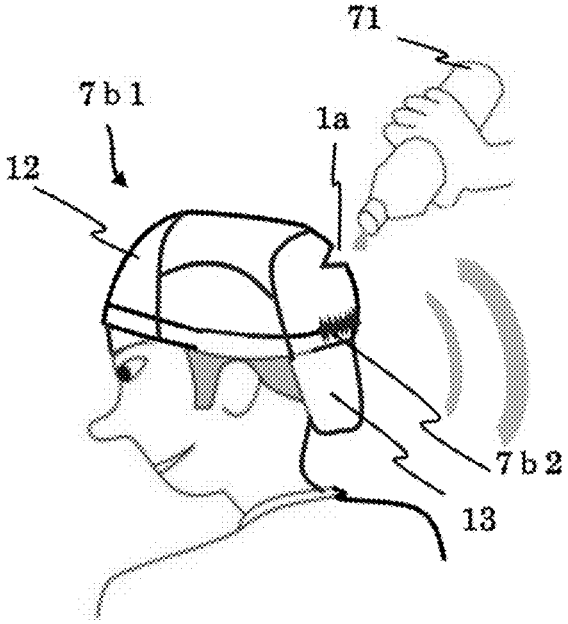

FIGS. 7A and 7B are drawings showing a usage state of the headgear or the like with the structure used for the present invention.

FIG. 7A shows an example of a cap-type headgear, and FIG. 7B shows a usage example of a hood worn under a helmet or the like.

The figures show a state that cold water flows from the main body portion 12 covering the head of a wearer of the headgear with the structure of the present invention to the absorbent materials 14, 15 or 3*b*1 placed inside the flap portion 13 covering the from the back of the head to the upper back of the neck while avoiding the size adjustment portion 21 or a size adjustment portion 7*b*2 for adjusting circumference size only by simply pouring cold water from a plastic bottle 71 into the water inlet 1*a* located at one part of the top portion of the main body portion 12. Thus, a long-lasting cooling effect through evaporative action of the internal absorbent material soaked in water can be obtained.

FIG. 9 is a transparent view showing an example of the flap hat for children with the structure of the present invention. As shown in the FIG. 9, a flap hat 91 for children or kindergartners has an elastic band 92 at the center of the back for adjusting the head circumference size.

Even in the above described case, the above described water channel connecting portion 23 of the configuration of the present invention can be formed avoiding a portion of the elastic band part 92.

Furthermore, the third embodiment of the structure of the present invention will be explained.

Figure 10A:
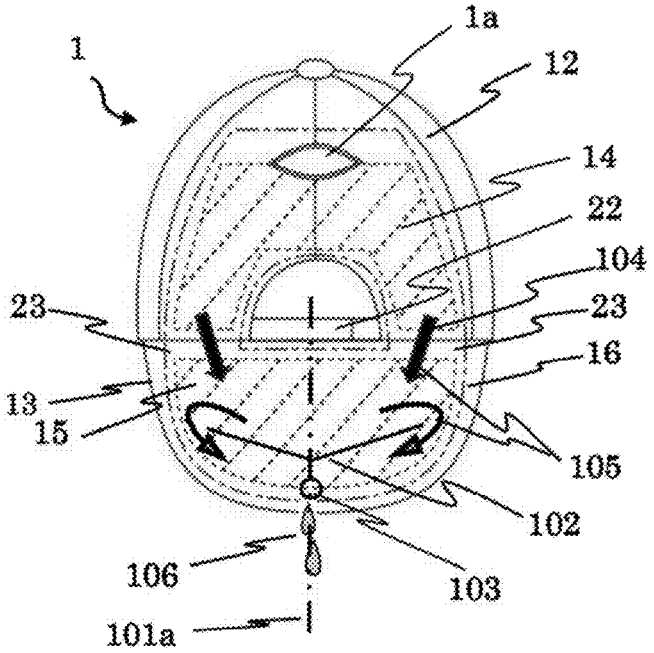
FIGS. 10A and 10B are drawings showing a drain outlet provided at the bottom edge of the headgear or the hood with the structure used for the present invention.
Figure 10B:
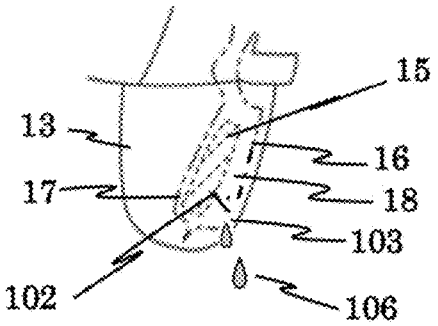

FIG. 10A shows the structure of the present invention viewed from the back. FIG. 10B shows the state when cut along a cross-section line 101*a*.

In the structure of the headgear or the like used for the present invention, a water stopping portion 102 is created by partially closing the gap 18 between the absorbent material 15 and the moisture-permeable waterproof fabric 16 at an intermediate position of the bottom edge of the flap portion 13 using adhesion or sewing.

In addition, a drain outlet 103 is provided at the lower edge of the moisture-permeable waterproof fabric 16 positioned below the water stopping portion 102.

A state that the water poured from the water inlet 1*a* flows through the gap 18 while the absorbent materials 14, 15 absorb and store the water is shown as the water flow direction 105. At this time, the water stopping portion 102 first gathers the flowing water from above toward the center of the flap portion. Thus, the water stopping portion 102 has the role of supplying the water to the center of the absorbent material 15 thoroughly and uniformly and the effect of making the evaporative cooling action uniform across the surface and long-lasting. After that, the water overflowing from both horizontal ends of the water stopping portion 102 is absorbed by both horizontal end surfaces of the absorbent material 15, and begins to drain as water droplets 106 from the drain outlet 103 at the bottom of the gap 18 as excess water, which can be detected visually or by touch.

When pouring the water from the water inlet to obtain the evaporative cooling effect of the headgear, the hood or the flap hat for children or kindergartners with the structure of the present invention, the drain outlet 103 provided by the structure allows the detection of water droplets 106 or the amount of water leaking from the drain outlet as excess water after the absorbent materials 14, 15 absorbs and stores sufficient water and this can be detected visually or by touch. Thus, the effect of making it possible to judge or practice how much water is optimal to pour into the headgear or the like using the cooling structure of the present invention.

If the drain outlet 103 is not provided, the wearer may pour too much water and a large amount of water is accumulated at the bottom edge of the flap portion. Thus, the wearer feel the weight of excess water on the back of the neck. Alternatively, the water retention seal created by adhesion, sewing or the like around the sheet-like surfaces of the inner and outer moisture-permeable waterproof fabrics 16, 17 may break, causing excess accumulated water with nowhere to go to unpleasantly and unsightly begin leaking from various gaps around the circumference while wearing the headgear. The structure of the present invention has the effect of solving the above described issues.

INDUSTRIAL APPLICABILITY

In recent years, due to climate change, there has been a strong call for the need to respond to and counter the harsh heat, heat stress, and heat stroke during people's outdoor activities in the summer.

Recently, with the widespread installation of vending machines in familiar living areas, it is easy to obtain plastic bottles containing cold water anytime, anywhere.

For example, the headgear, the hood for helmet inner or the like with the structure of the present invention, realizes long-lasting cooling effects with cold water temperature and evaporative cooling for the part of the human body from the back of the head to the back of the neck, which controls motor nerves, very easily, anytime, anywhere.

The widespread adoption of the present invention can lead to reducing anxiety about heat, heat stress and heat stroke during outdoor activities and outdoor work in midsummer, lessening physical burden, and greatly improving the efficiency of social activities in summer with significant expected effects on society and industry.

DESCRIPTION OF THE REFERENCE NUMERALS

1: headgear
12: main body portion
13: flap portion

14: first absorbent material
15: second absorbent material
16: outer moisture-permeable waterproof fabric
17: inner moisture-permeable waterproof fabric
18: sheet-shaped gap
21: head circumference size adjustment portion
23: water channel connecting portion
1*a*: water inlet
3*c*1: water channel connecting portion of main body portion side
3*c*2: water channel connecting portion of flap portion side
51, 52: evaporation ventilation window
7*b*2: hood
102: water stopping portion
103: drain outlet
105: water flow direction

The invention claimed is:

1. A cooling structure of a headgear or a hood, comprising:

a main body portion configured to cover a top portion of a head of a person; and a flap portion configured to cover from a back of the head to an upper back of a neck of the person, wherein the main body portion is provided with a water inlet, the main body portion and the flap portion are provided with an absorbent material having a sheet shape for absorbing and retaining water poured from the water inlet and a moisture-permeable waterproof fabric overlapped with the absorbent material to cover a part of one side or both sides of the absorbent material, a head circumference size adjustment portion of the headgear or the hood is provided on the main body portion to adjust a circumference size of the headgear or the hood to fit the head of the person, a water channel is provided by a gap between the absorbent material and the moisture-permeable waterproof fabric to allow the water poured from the water inlet to flow and spread in a sheet-like manner in the main body portion and the flap portion, and the water channel of the main body portion, which is located above the head circumference size adjustment portion, and the water channel of the flap portion, which is located below the head circumference size adjustment portion, are connected with each other on both left and right sides of the head circumference size adjustment portion of the headgear or the hood avoiding the head circumference size adjustment portion so that the water flows from the main body portion to the flap portion for cooling from top portion of the head to the upper back of the neck integrally through an evaporative cooling effect of the water absorbed and retained by the absorbent material.

2. The cooling structure of the headgear or the hood according to claim 1, wherein the absorbent material is separated into a first absorbent material covering the back of the head in the main body portion and a second absorbent material covering from a lower portion of the back of the head to the upper back of the neck in the flap portion, and the water channel of the main body portion and the water channel of the flap portion are connected with each other in a state that the first absorbent material and the second absorbent material at a connection portion between the water channel of the main body portion and the water channel of the flap portion.

3. The cooling structure of the headgear or the hood according to claim 2, wherein the water channel connecting the main body portion and flap portion is formed of the moisture-permeable waterproof fabric having a tubular shape, the diameter of the tubular shape of the water channel of the main body portion is smaller than the diameter of the tubular shape of the water channel of the flap portion, and the tubular shape of the water channel of the main body portion and the tubular shape of the water channel of the flap portion are assembled in a sheath-tube manner in a state that the tubular shape of the main body portion is inserted into the tubular portion of the flap portion.

4. The cooling structure of the headgear or the hood according to claim 2, wherein a drain outlet for discharging excess water is provided at a bottom edge of the flap portion as a means to know when the water poured from the water inlet has reached the bottom edge of the flap portion after the water flows from the main body portion through the water channel connecting the main body portion with the flap portion and the water is absorbed and retained by the first absorbent material and the second absorbent material.

* * * * *